United States Patent [19]

Beebe

[11] Patent Number: 4,926,163

[45] Date of Patent: May 15, 1990

[54] METHOD AND APPARATUS FOR ADVANCE WARNING SIGNALLING TO A MOTORIST OF AN ICE CONDITION ON A DRIVING SURFACE

[75] Inventor: Russell B. Beebe, Scotts Mills, Oreg.

[73] Assignee: IceAlert, Inc., Scotts Mills, Oreg.

[21] Appl. No.: 305,304

[22] Filed: Feb. 1, 1989

[51] Int. Cl.[5] ..... G08B 19/02

[52] U.S. Cl. ..... 340/581; 340/594; 340/691; 340/584

[58] Field of Search ..... 340/581, 580, 584, 593, 340/594, 691, 815.1, 815.26

[56] References Cited

U.S. PATENT DOCUMENTS

| | | | |
|---|---|---|---|
| 2,301,247 | 11/1942 | Bronée | 73/342 |
| 2,849,701 | 8/1958 | Clark | 340/581 |
| 2,902,669 | 9/1959 | Lucarelli | 340/580 |
| 3,164,820 | 1/1965 | Hulett | 340/581 |
| 3,229,271 | 1/1966 | Frant | 340/581 |
| 3,596,264 | 7/1971 | Ciemochowski | 340/581 |
| 3,613,063 | 10/1971 | Ciemochowski | 340/581 |
| 3,810,139 | 5/1974 | Fergusson | 340/581 |
| 4,222,044 | 9/1980 | Boschung | 340/581 |

*Primary Examiner*—Joseph A. Orsino
*Assistant Examiner*—Geoff L. Sutcliffe
*Attorney, Agent, or Firm*—Edward J. DaRin

[57] ABSTRACT

A method and apparatus for advance warning signaling to a motorist of an ice condition on a driving surface. The method steps include mounting a plurality of traffic signalling devices along a driving surface for sensing the prevailing temperatures and thereby continuously signal a motor vehicle operator of the changes in temperature as he approaches a driving surface subject to freezing to permit him to take any necessary precautionary corrective action in driving the motor vehicle. The signalling devices utilize thermostat elements for sensing a narrow temperature range adjacent the freezing temperature and provide visible signals, preferably two colors for signalling a warm or nonhazardous temperature, a cold temperature signalling a frozen driving surface or a combination or mixture of the colored signals to permit the motor vehicle operator to be warned, in advance, as he approaches a driving surface that is becoming colder, leading to a stretch of a driving surface that may be frozen.

24 Claims, 4 Drawing Sheets

FIG. 7.
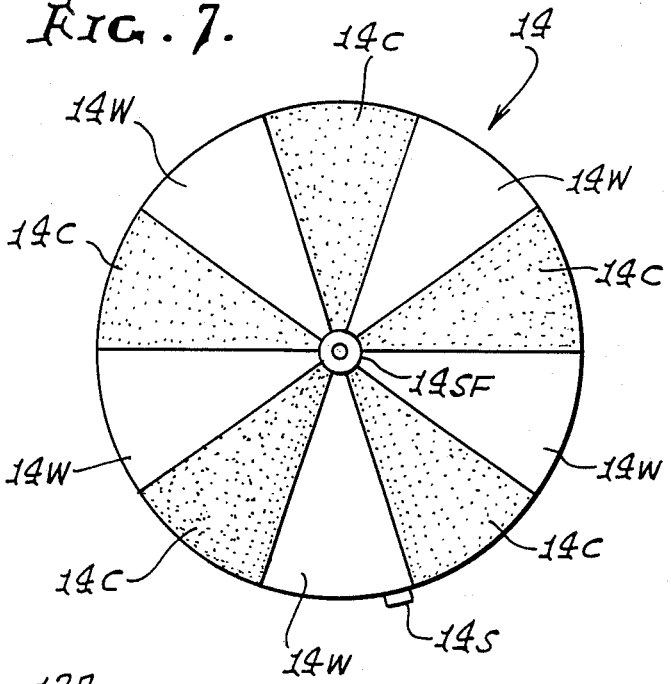
FIG. 8.
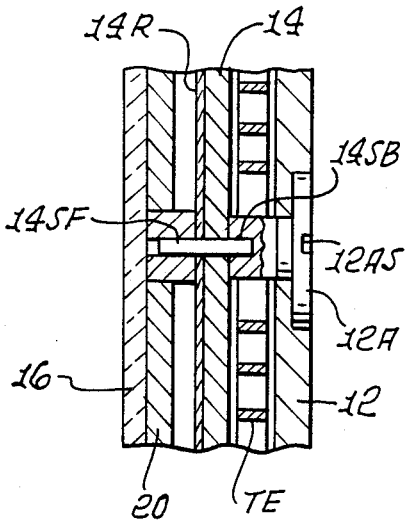
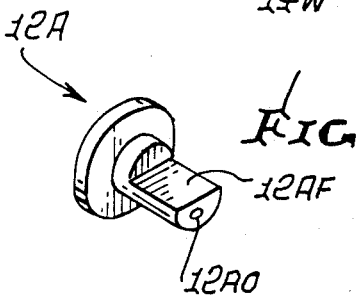
FIG. 9.
FIG. 10.
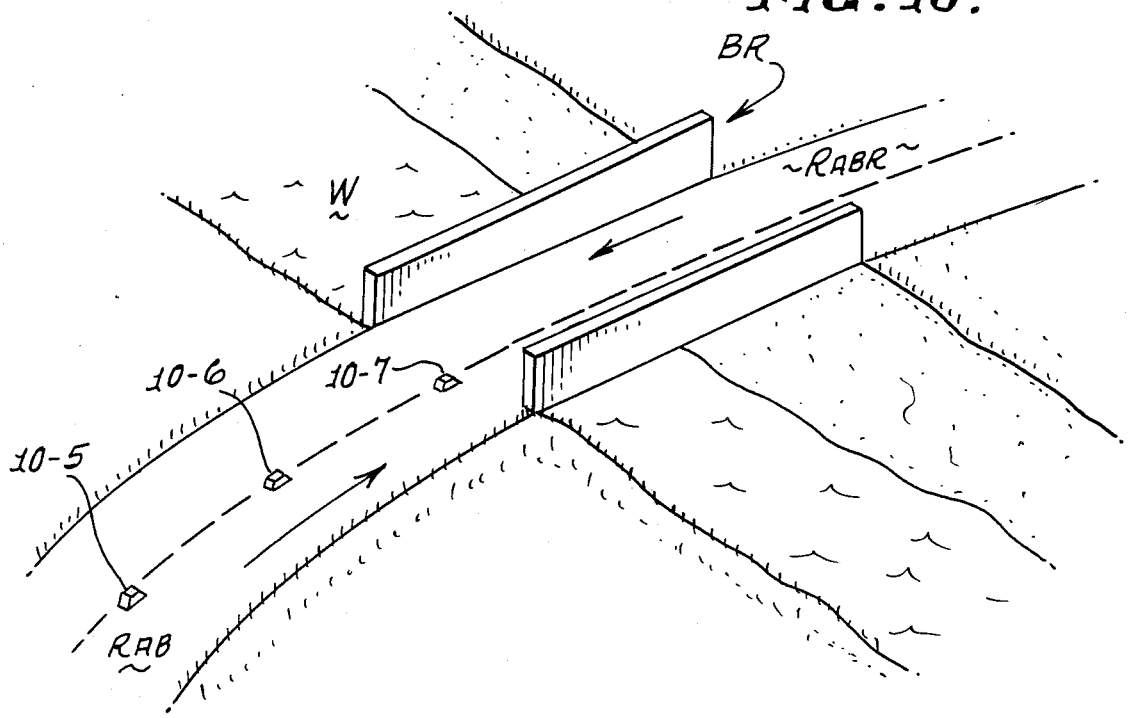

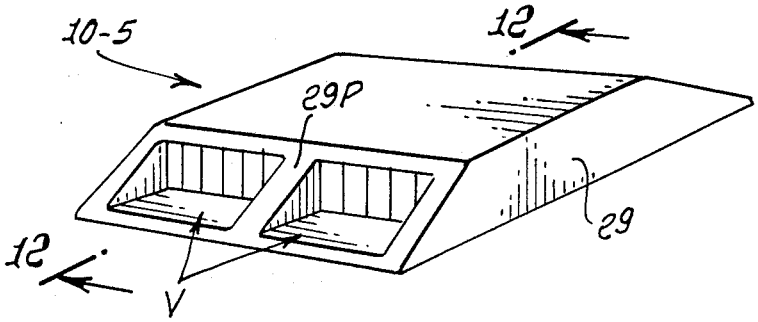
FIG. 11.
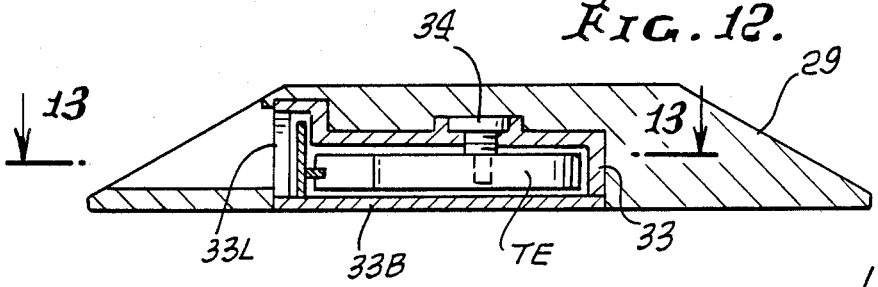
FIG. 12.
FIG. 13.
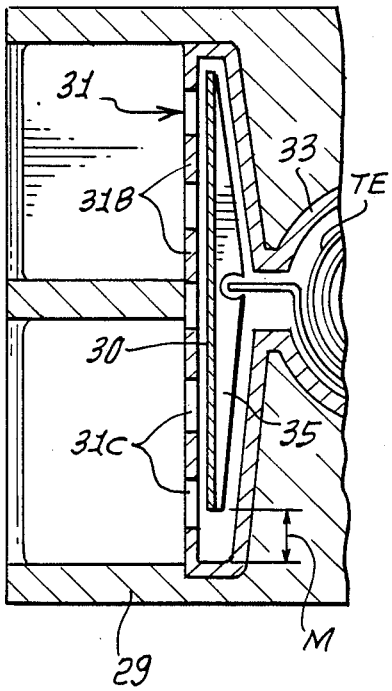
FIG. 14.
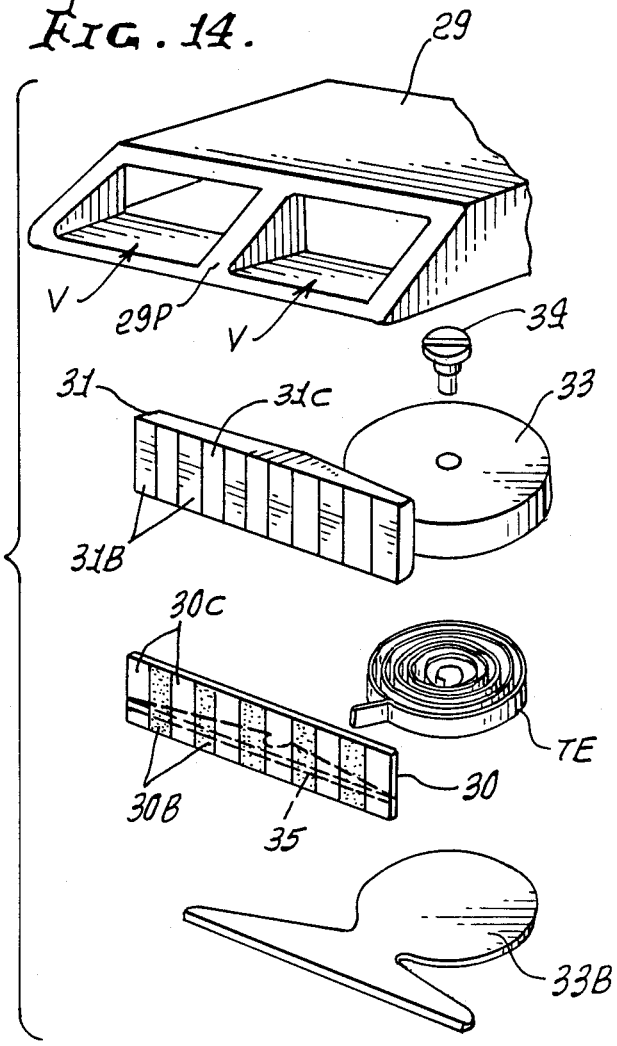

METHOD AND APPARATUS FOR ADVANCE WARNING SIGNALLING TO A MOTORIST OF AN ICE CONDITION ON A DRIVING SURFACE

FIELD OF INVENTION

This invention relates to traffic signalling devices and, more particularly, to an advance warning signalling system of a hazardous driving condition, such as ice on a motor vehicle driving surface.

BACKGROUND OF THE INVENTION

As a result of many years of professional driving over roads of various constructions and on various terrains, on bridges, or the like adjacent to inland bodies of water and in coastal areas, I have learned that under certain conditions, portions of a driving surface or on a bridge may have ice or frost thereon, and the motorist may suddenly encounter such conditions without prior warning when driving onto a stretch of road that has ice or frost thereon, thereby substantially risking slipping and sliding of the motor vehicle leading to loss of control and/or damage to the motor vehicle and injury to the driver and/or occupants of the passenger car, truck, or bus. At the present time I have no knowledge of any reliable advance warning device for signalling such an icy condition on a motor vehicle driving surface that delineates a particular area of the surface in advance that produces such a problem. A highway, for example, may be constructed in areas subject to snow and/or freezing with a portion of the highway being constructed at a lower elevation than the elevation of the highway approach to such an area and lower than the exit driving area through which the motorist must pass. When driving on road surfaces having differences in elevation in cold weather subject to freezing temperatures, the road surfaces on both sides of the area having the lower elevation may be around freezing temperatures (35 degrees Fahrenheit) but without producing freezing and ice and are therefore not subject to causing slipping and sliding of the motor vehicle, while the area forward of the same road surface having a lower elevation may be a few degrees cooler (32 degrees Fahrenheit) and thereby may be at or below the freezing temperatures, causing ice to be formed in these stretches of the road or the frosting of the surface to produce a hazardous driving condition, especially when no advance warning is provided. When the motorist travels on such a road surface, he may be traveling at a speed that when he unexpectedly enters the icy areas and is surprised as to the driving conditions, the risk of an accident, damage or injury is substantial. This ice condition may also prevail when the driving surface is adjacent a body of water, such as in coastal areas or the like, and the road surface is at different elevations or on a bridge across a body of water or the like. The advance warning signalling of such ice conditions to motorists would substantially reduce the risks of encountering such areas by surprise to thereby minimize accidents, slipping and sliding due to ice or frost conditions on the highway being traveled by the motor vehicle.

At the present time there is in use on highways standard signs with legends that call a motorist's attention to potentially hazardous conditions, such as "Slippery When Wet", "Ice", or the like, but do not segregate any particular stretch of the highway that may be dangerous from those that are usually safe to drive on, i.e., above freezing temperatures. The patent art does disclose various types of devices for sensing air temperature and/or for temperature of a road surface for detecting and warning of icy conditions. All of the known devices are considered to be relatively complex, mechanical and/or electronic devices that are expensive to manufacture and put in use. To my knowledge these patented devices are generally not in use. The known patents include U.S. Pat. No. 2,301,247 of Bronee granted on Nov. 10, 1942. The Bronee patent discloses a rather complex mechanical system for sensing the temperature of the air and the temperature of the surface of a road for indicating an icy formation on a road surface for traffic signalling purposes. Other patents, such as the Clark U.S. Pat. No. 2,849,701, disclose complex electronic systems for sensing a variety of road conditions along a highway and signalling same to a motorist. These types of devices may not only provide a sign with a legend indicating the hazardous conditions, but also the suggested safe driving speed. Devices of this type are designed to return to a normal non-icing condition upon a rise in temperature and the passing of such a condition and are also disclosed in the Lucarelli Pat. No. 2,902,669, the Hulett Pat. No. 3,164,820, Ciemochowski Pat. Nos. 3,596,264 and 3,613,063. Other prior art patents of this type are the Frant Pat. No. 3,229,271 and the Boschung Pat. No. 4,222,044. These patents disclose ice sensing systems that operate at a particular location, such as a bridge, and disclose various types of indicators, none of which are of the simple and inexpensive type and construction of my invention.

SUMMARY OF INVENTION

The present invention provides an improved method and apparatus for advance warning signalling to a motorist that he is approaching an icy condition on a motor vehicle driving surface to permit the motor vehicle operator to become more attendant to his driving, including reducing speed prior to reaching the icy driving surface for avoiding loss of control and/or damage that may result from traveling at a high speed on the icy surface. The method of the present invention comprehends mounting of a plurality of signalling devices in a spaced apart relationship along a driving surface for sensing the ambient air temperature or the temperature the driving surface is exposed to. The signalling devices are positioned to permit the motor vehicle operator to successively view the signalling device as he advances along the road with his motor vehicle. The signalling devices may be mounted along the driving surface forming an approach to the icy driving surface and the opposite or exit side of the icy driving surface in the direction of travel of the motor vehicle. The signalling device may be provided for sensing temperatures between 31 to 35 degrees Fahrenheit for the purposes of the present invention, so that the signalling devices spaced the farthest distance from a stretch or length of driving surface subject to icing may signal a non-icying condition or warm temperature, i.e., above 35 degrees Fahrenheit, and the successive signalling devices may progressively change their signal from a completely non-icing condition to an icing condition signal whereby the gradual changes of the signals resulting from temperature change in the 35 to 31 degree range viewed by the motorist as he progresses along the driving surface, alerts him that he is approaching an icy condition or an area wherein the temperatures are approaching freezing and/or frosting, so that he can reduce the motor vehicle speed before traveling on the icy surface to avoid any unexpected action of his motor vehicle.

The method of the present invention utilizes the improved signalling devices of the present invention which are simple in concept and inexpensive to construct and which utilize a thermostat element for sensing temperatures, either of the ambient air temperature or the temperature of the driving surface, dependent on whether the signalling devices are mounted above the driving surface or on the driving surface respectively. The thermostat element provides the necessary mechanical driving forces, bidirectionally, for changing the color signals displayed by the device as it is viewed by a motor vehicle operator from a nonfreezing or "warm" signal to a freezing or "cold" signal gradually as the sensed temperatures decrease to alert the motor vehicle operator to an approaching, freezing road surface.

From a method standpoint, the present invention comprehends a method of early warning signalling to a motorist in the event of ice formation on a driving surface which might be likely to arise or have been known to occur, including the steps of mounting in a spaced relationship a plurality of signalling devices along a driving surface for signalling an ice condition, a non-ice condition, or an intermediate condition between the ice and non-ice conditions and the direction of change between the two conditions in the direction a motor vehicle is traveling. The present invention continuously signals an advancing motorist of the ice or frosting, non-ice or non-frosting condition of the road surface, as well as the continuous changes in road condition temperatures between the ice and non-ice conditions and the direction of the changes as viewed by the motorist traveling along the driving surface. The spacing of the signalling devices afford the motor vehicle operator sufficient time to view the successive signals and observe the gradual changes in the colors and the color mix to identify the drop of temperature and sufficient time to take any precautionary care in his driving of the motor vehicle before traveling onto the frozen or frosted driving surface.

From the standpoint of the structural organization of a traffic signalling device, the invention comprehends a traffic signalling device for detecting the presence of a hazardous or safe driving condition at a preselected distance therefrom. The device comprising a bidirectional, thermal sensitive sensor adapted to provide preselected mechanical forces in response to a preselected temperature range relative to a freezing temperature and signalling means coupled to the thermal sensitive sensor to be bilaterally, movably responsive to the mechanical forces generated by the sensor with any increases and decreases of temperature over the preselected temperature range. The signalling means is adapted for signalling the temperature changes sensed by the thermal sensor over the preselected range by changing a visual signal of either a safe or hazardous (icy) driving condition in response to the mechanical forces generated by the sensor in response to the sensed temperatures whereby a "warm" sensed temperature provides a first signal and a sensed "freezing" temperature provides a second signal and any sensed temperature between the warm and freezing temperatures provide a third signal that is a combination or mixture of the first and second signals proportioned in accordance with their relationship to the freezing temperature and the distance from the area subject to freezing. The bidirectional thermal sensitive sensor may be a conventional thermostat element comprising a coiled thermostat element for coupling bidirectional movement to the signalling means.

BRIEF DESCRIPTION OF THE DRAWINGS

These and other features of the present invention may be more fully appreciated when considered in the light of the following specification and drawings, in which:

FIG. 7 is a front elevational view, taken along the line 7—7 of FIG. 6 and illustrating the signalling element of the traffic signalling device;

FIG. 8 is a partial, cross-sectional view taken along the line 8—8 of FIG. 4, illustrating the assembly of the elements comprising the traffic signalling device;

FIG. 9 is a detached, perspective view of the adjustable element of the traffic signalling device for adjusting the thermostat element;

FIG. 10 is a diagrammatic representation of a bridge overlying a body of water and illustrating an alternative embodiment of the traffic signalling devices of the invention adapted for mounting on the driving or road surface;

FIG. 11 is a front elevational view of the detached, traffic signalling devices illustrated in FIG. 10;

FIG. 12 is a cross-sectional view, taken along the line 12—12 of FIG. 11 of the traffic signalling device;

FIG. 13 is a partial, cross-sectional view, taken along the line 13—13 in FIG. 12 illustrating the manner in which the thermostat element is secured to the movable signalling element for the traffic signalling device of FIG. 11; and FIG. 14 is an exploded view of the device of FIG. 11 showing the assembly relationship between the signalling elements thereof.

DETAILED DESCRIPTION OF PREFERRED EMBODIMENTS

Figure 1:
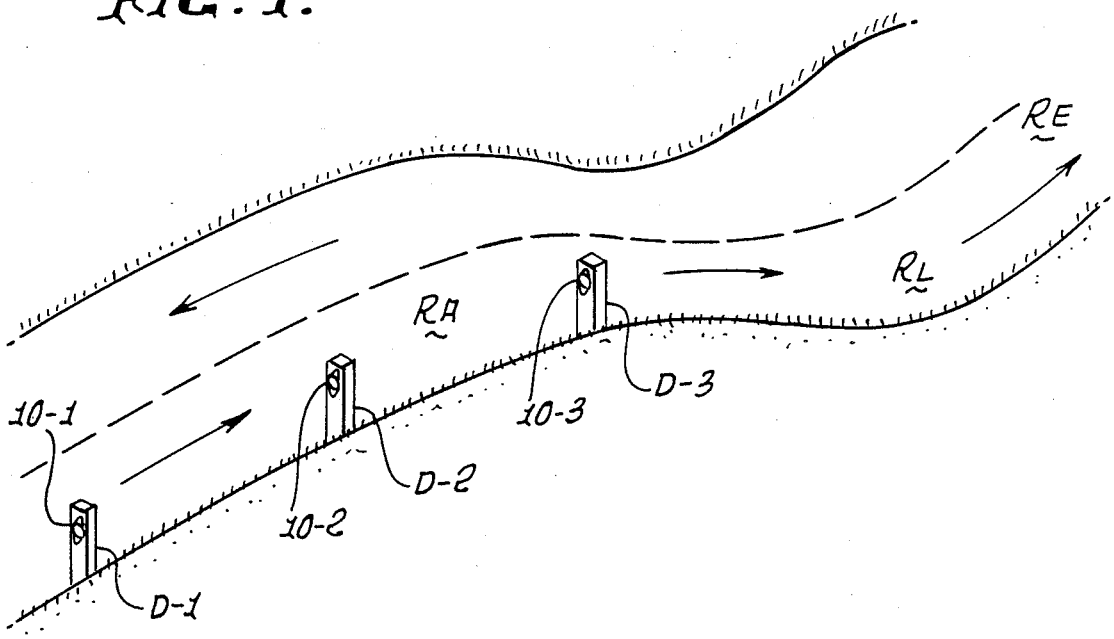
FIG. 1 is a diagrammatic representation of a roadway or driving surface having different elevations and illustrating a plurality of traffic control delineators having the traffic signalling device of the present invention mounted thereon for viewing by motorists traveling from left to right along the driving surface, as viewed in FIG. 1 and embodying the present invention.

Now referring to the drawings, the detailed description of the traffic signalling device of the present invention will be described as it may be implemented for mounting on a conventional traffic delineator post for positioning along a road surface. In order to facilitate the complete understanding of the invention, however, and before describing the details of the signalling device per se, the need for such a signalling device along certain roadways or driving surfaces will be examined in conjunction with FIGS. 1 and 10.

It is known that certain roads or highways have stretches or lengths that are at lower elevations than the immediately adjacent elevations of the same road surfaces, as diagramatically illustrated in FIG. 1, for example. It is presently known that roadways that are constructed over such irregular terrains, particularly road surfaces along coastal areas that are subjected to ambient temperatures approaching freezing but not frozen, at the higher elevations of the road surface, but the road surface may be frozen at the lower elevations. Only a small difference in temperature will cause the length of a road at the lower elevation and subject to the freezing temperatures to freeze or ice over, thereby producing a hazardous driving condition for a motor vehicle operator who drives onto the ice suddenly and unexpectedly. The same type of icing condition may prevail on a bridge spanning an area of a lower elevation, such as a river or similar body of water over which the bridge is constructed. In this example, the surface of the bridge may be iced while the bridge approaches are not frozen. In the event the motor vehicle operator is traveling at a relatively high rate of speed when he comes onto the bridge without knowing of the icy condition, the ice may cause the motor vehicle to slip or skid and the operator to lose control and veer into the oncoming traffic, thereby causing damage to the motor vehicle, property or injury to the passengers therein. If the motorist is provided with advanced warning that he is approaching such an iced road surface, the operator can take the necessary precautions to reduce the speed of the motor vehicle prior to traveling on the iced road surface to avoid the possibility of an accident.

The traffic signalling devices of the present invention may be mounted to a conventional traffic delineator post positioned along the side of a roadway (see FIG. 1) to permit the operator to successively view the advance warning signals as he passes by each of the signals for evaluating the changing signals and thereby the temperature conditions of the ambient air or the road surface proper (see FIG. 10). Preferably, the devices are mounted to permit motor vehicle operators traveling in both directions on the road surface to successively view the traffic signalling devices that are mounted not only on the approaches to an iced surface, but also the iced surface and the exit surface (not shown). Although only three signalling devices are shown in FIGS. 1 and 10 for illustrating the use of the devices for the purposes of the invention, in a practical usage of the devices, a series of devices spaced four to five hundred feet apart may be utilized. The signalling devices per se are constructed and defined to sense and signal a temperature range of approximately 4 degrees or between 31 to 35 degrees Fahrenheit. The high end of the temperature range, i.e., 35 degrees Fahrenheit, can be considered to be a "warm" temperature while the "cold" temperature is 32 degrees Fahrenheit and below. In the signalling devices mounted on the delineator posts in FIG. 1, the devices are constructed and defined to be rotatably responsive to the sensed temperature changes. For this purpose, rotary motion on the order of 36 degrees will signal the temperature range of 31 to 35 degrees. The "warm" or "hot" temperature of 35 degrees would signal a warm color, such as silver, while the cold temperatures are signalled by a "cold" color such as blue. Sensed temperatures between 32 degrees and 35 degrees are signalled by the continuous changes between a hot color and a cold color so that the signal viewed by the advancing motor vehicle operator will be a combination or mixture of the hot and cold colors. As the motorist drives away from the warm area and approaches the colder areas, the "cold" color will become visible along with the "hot" color. As the motorist approaches the frozen area, the signals continuously change so that more of the "cold" color is visible and less and less of the "hot" color to thereby indicate a frozen area is being approached.

It should be noted at this point that the temperature range over which the device is used for signalling is very narrow but is effective as constructed and disclosed by the present specification. It is recognized that some individuals skilled in the construction of thermostat elements are of the opinion that such elements cannot be constructed to provide sufficient operating forces or torque in the compact manner required for the purposes of the present invention over the desired, small temperature differential. To provide the desired signalling in accordance with the teachings of the present invention and despite these "expert" opinions, the device does acceptably function and readily changes signals in going from a "hot" temperature of 35 degrees Fahrenheit to a "cold" temperature of 32 degrees Fahrenheit in the disclosed configurations.

The improved traffic signalling devices will first be examined and described as they are constructed and defined for mounting on a traffic delineator post of conventional construction that is usually mounted alongside a roadway, as illustrated in FIG. 1. Three such delineator posts are identified as the posts D-1, D-2, and D-3 as illustrated in FIG. 1 in spaced apart relationship, along the side of the roadway $R_A$. Each of the delineator posts D-1, D-2, and D-3 have secured thereto on a face thereof that is viewable to an advancing motorist, one of a plurality of the traffic signalling devices constructed in accordance with the present invention and are identified as the devices 10-1, 10-2 and 10-3 and are respectively mounted on the posts D-1, D-2 and D-3. The number of posts selected is dependent upon the terrain of the stretches of a roadway having approximately the same elevation and the stretch of a roadway of a lower elevation to provide advance signalling by the selected number of devices 10-1, 10-2, etc., to sufficiently alert a motorist driving his motor vehicle along the approach to the area of the road having the ice condition. In FIG. 1, the approach to the iced area is identified as $R_A$ while the roadway of lower elevation subject to freezing is identified as $R_L$. The exit area from the $R_L$ area on the roadway is identified as $R_E$. The signalling devices are only illustrated in FIG. 1 for a motor vehicle traveling from left to right, and it should be understood that a similar series of delineator posts and traffic signalling devices would be mounted along the opposite side of the roadway for signalling motor vehicles traveling from right to left, i.e., $R_E$ to $R_L$ to $R_A$. The devices 10-1, 10-2 and 10-3 are identically constructed, and one device 10-1 need only be described in detail.

Figure 4:
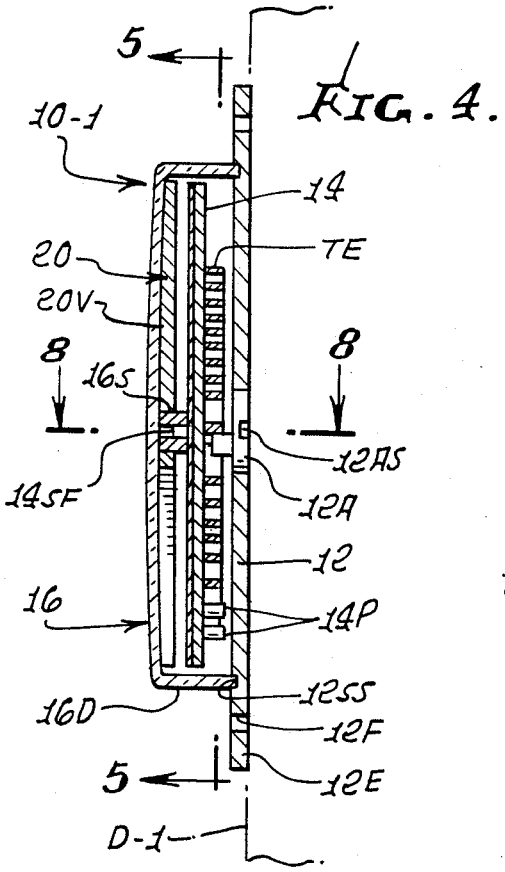
FIG. 4 is a cross-sectional view taken along the line 4—4 of FIG. 2.
Figure 5:
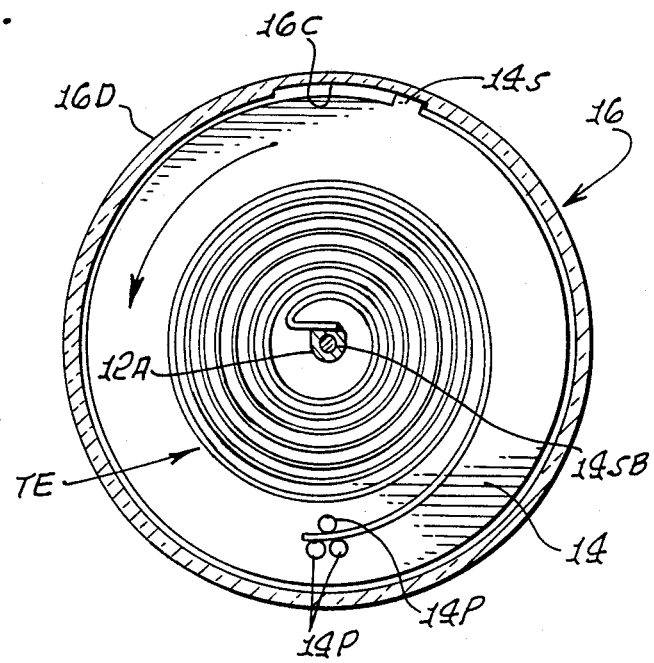
FIG. 5 is a cross-view taken along the line 5—5 of FIG. 4 and illustrating the manner of securing the flat ends of the thermostat element for the traffic signalling device.
Figure 6:
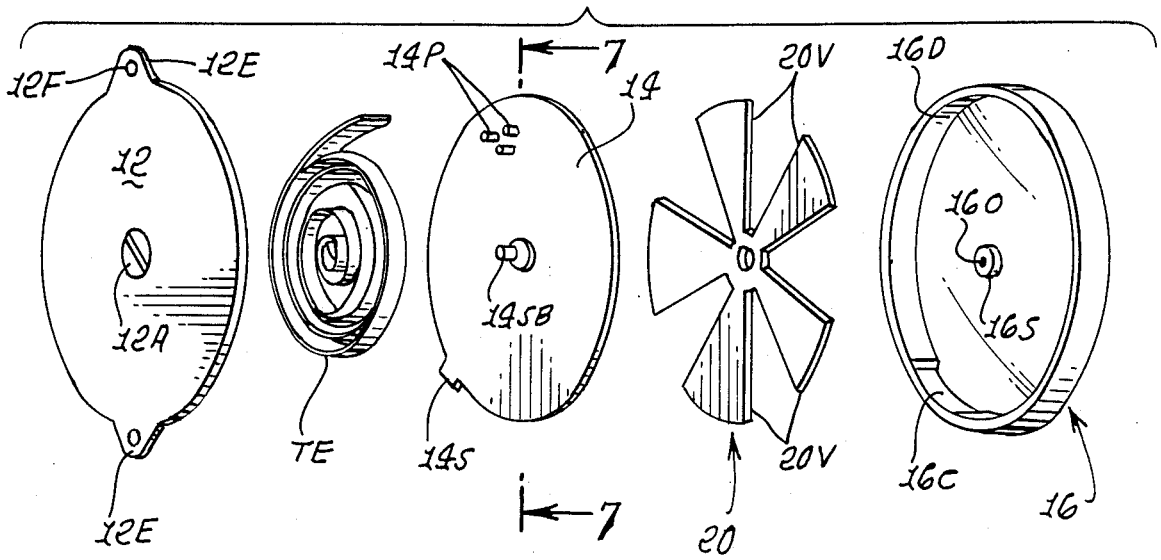
FIG. 6 is an exploded view of the elements of the traffic signalling device detached from the delineator.

The basic element of the traffic signalling device 10-1 is the thermostat element TE; see FIGS. 4–6. The thermostat element TE is a commercially available element and for the purposes of constructing the signalling device 10-1, a thermostat element manufactured and sold by Hood & Company, Inc., P. O. Box 485, Hamburg, Pennsylvania 19526, the Hood type 36-10, thermostat metal has been satisfactorily employed. An equivalent, commercially available thermostat metal is manufactured and sold by Texas Instruments, Inc., through its Thermostat Metals Department in Attleboro, Massachusetts, and sold as Texas Instruments Model P675R thermostat metal. Both the Hood type and the Texas Instrument type thermostat metals are commercially identified as ASTM type - TM2 type metals. Although it is well-known as evidenced by the commercial availability of the thermostat materials from the aforementioned suppliers, it should be noted for the sake of completeness that the thermostat element TE is constructed of a thermostat metal in the form of a strip or sheet comprising two or more metallic layers having different coefficients of expansion and permanently bonded together. The metallic layers cause the material to change in its curvature in response to temperature changes and this change is bidirectional and thereby provides the necessary mechanical driving forces for the purposes of the present invention. The element TE as illustrated in the drawings has flat ends that are rigidly mounted to their supports so that the active lengths of the thermostat bimetal are clearly defined between the secured ends and closely maintained for sensing a desired temperature range.

The element TE has a coiled configuration of thermostat metal having a length of 60 inches and a total weight of 1/44 of a pound and produces a torque of 0.1 ounce-inches. Each end of the coiled thermostat element has a flat end to allow it to be solidly secured to define the active length therebetween. It will be recognized by those skilled in the thermostat art that any temperature spread may be accommodated by the element TE in accordance with the active length of the coil and that the temperature spread may be calibrated or adjusted by merely changing the active length of the coil by cutting off a length of the metal element of the coil prior to final assembly or by adjusting the length after assembly and before sealing it in the device 10-1. The thermostat element TE in its coiled configuration in its final assembly in the traffic signalling device 10-1 is arranged between a back plate 12 for the device and the light member 14 as mounted inside of the cover or housing means 16 for the device 10-1; see FIG. 4. The back cover 12 is provided with an adjusting fastener or an adjustable stub shaft 12A for securing the inner flat end of the thermostat element TE securely thereto as best illustrated in FIG. 5. The adjustment fastener 12A is preferably rotatable relative to the cover 12 proper and for this purpose is provided with a slot 12AS on its head to accept a screw driver or similar tool that allows it to be rotated for controlling the active length of the thermostat element TE extending outwardly from element 12A. The stub shaft 12A is of a semi-circular configuration so that the flat surface of the element 12A may mount and secure the inner flat end of the thermostat element TE. The opposite end of the thermostat element TE is secured to the back side of the light member 14 as best seen in FIG. 5. The back side of the element 14 is provided with three spaced, short securing posts 14P arranged adjacent the outer periphery of the light member 14 constructed in the form of a rotatable disk. The posts 14P are arranged as illustrated in the drawings (see FIGS. 5 and 6) with two posts 14P extending outwardly of the back side of the member 14 and arranged in a spaced, side-by-side relationship with a third post 14P being spaced inwardly from the other two posts 14P to provide a space for receiving and firmly securing the free end of the coiled thermostat element TE therebetween. The outer periphery of the light member 14 is also provided with a stop 14S defined for controling the angular extent of rotary movement of the light member 14 as will be explained hereinafter. The light member 14 is provided with a short stub shaft extending outwardly from both sides of the light member 14 for rotatably mounting the member relative to the backplate 12 and the cover 16. The stub shaft extending from the back side of the member 14 is identified in FIG. 6 as 14SB. The front side of the member 14 has its stub shaft identified as 14SF and can be best viewed in FIG. 4. The fastener 12A has an aperture 12AO provided at its inner end to rotatably receive the inner end of the shaft 14SB for the light member 14; see FIGS. 8 and 9. The shaft 14SF for the light member 14 is rotatably mounted to the cover by means of the aperture 160 provided for the stub shaft 16S for the cover 16.

The front face of the light member 14 is best appreciated by examining FIG. 7. The front face of the light member has a thin, light reflecting disk 14R bonded thereto. The disk 14R is sub-divided into segments of two different colors for providing the desired signals from the device 10-1 to be viewed by the advancing motorist. The light member 14 has its front face divided into two pairs of five segments of different colors for signalling the different temperature conditions sensed by the thermostat metal TE from above freezing temperature to a freezing temperature. For this purpose five segments having the same color are arranged alternately on the face of the member 14 with similar segments having a different, contrasting color provided. The segments representative of a warm temperature or a temperature above freezing as illustrated in FIG. 7 are identified as the segments 14W. A preferred color that is selected for this temperature signalling may be a silver color or, alternately, an amber color. The alternate segments representing a cold temperature are illustrated in a stippled form and identified as the segments 14C and which may be a blue color. The color blue was chosen to represent the signal for a freezing temperature because of its usual association as a "cold" color. Specifically, a light blue was chosen for this signalling because it normally mixes or combines well with the silver color for signalling purposes. The mixing of the colors results when the thermostat element TE slowly responds to temperatures running between 35 degrees Fahrenheit and 32 degrees Fahrenheit along the road surface $R_A$ so that the gradual changes in the mixture of colors will be meaningful or convey temperature information to the motor vehicle operator as he passes each of the signalling devices 10-1, 10-2 and 10-3 in traveling from a warm zone to a cold zone. Similarly, the number of segments employed for the disk 14 has been selected to allow the eye to mix the colors to be recognizable by the eyes of the motorist as the signals gradually change from silver to light blue.

The remaining element of the device 10-1 is the masking element 20 which is best illustrated in FIG. 6 in its detached form. The masking element 20 consists of a circular or disk-like element having five solid light blocking vanes 20V spaced apart by openings as best appreciated from examining FIG. 6. The vanes 20V are coextensive with the signalling areas on the light member 14 having the same color, such as the areas 14C on the front face of the light element 14. Similarly, the spacing between the vanes 20V has a defined segmental opening of the same area as the segments of the different color or the segments 14W on the member 14. In this manner, when the device 10-1 is initially assembled, it is assembled so that the vanes 20V each substantially overlie the cold signalling areas 14C of the member 14 so that only the silver segments 14W are visible from the opposite side of the masking member 20. The masking member 20 is provided with a central aperture to accommodate a stub shaft 16S extending outwardly from the inside surface of the cover 16. The masking member 20 is mounted inside the cover 16 in intimate relationship with the inside face of the U-shaped cover and around the shaft 16S to be arranged in a fixed position therein so as to provide the desired masking action of the segments 14W and 14C on the light member 14.

When the cover 16 is mounted over the masking member 20 and the light member 14, the light member 14 is mounted so that only the stop 14S falls within the opening 16C on the inside of the skirt 16D within its inner periphery of the cover, as best examined in FIG. 6. The peripheral edge of the light member 14 is spaced from the skirt 16D to allow it to rotate relative to the cover 16 and mask 20 within the limits defined by the opening 16C, i.e., 36 degrees of rotation. The outside face of the cover 16 is constructed of a light transmitting material and preferably is of a concave configuration shaped in the form of a lens rather than a flat surface for viewing the signalling elements 14W and 14C therethrough, as exposed through the masking member 20; see FIGS. 2 and 3. When the cover 16 mounts the aforementioned elements, it is secured to the back cover 12 as a result of the provision of the circular slot 12SS in the back plate 12 (see FIG. 4) having a diameter to accomodate the skirt 16D of the cover 16 therein for securing the two together and preferably sealing all of the elements therein to allow the thermostat element TE and prevent dust or other foreign matter from entering the device 10-1.

Figure 2:
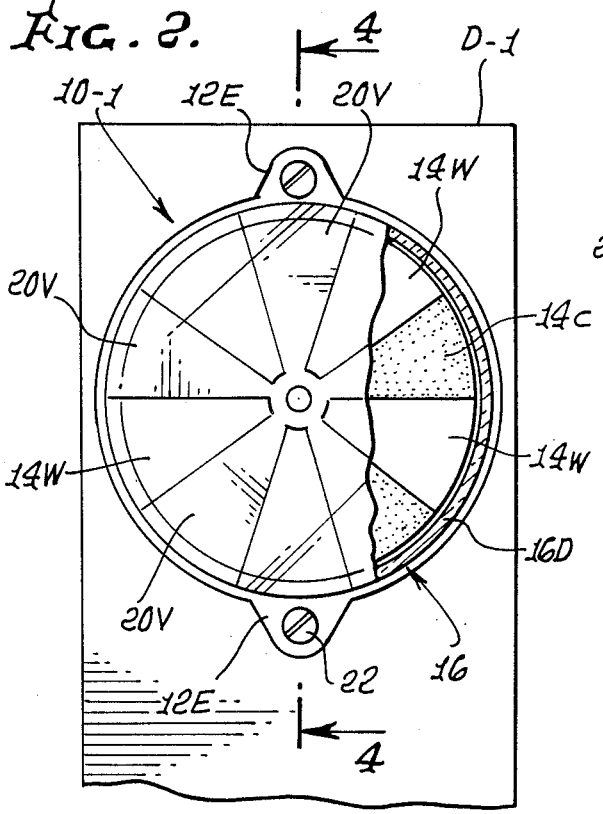
FIG. 2 is a partial front elevational view of the delineators illustrated in FIG. 1, with portions of the cover for the traffic signalling device of the present invention broken away and illustrated as signalling a warm or non-icing condition of the road surface.
Figure 3:
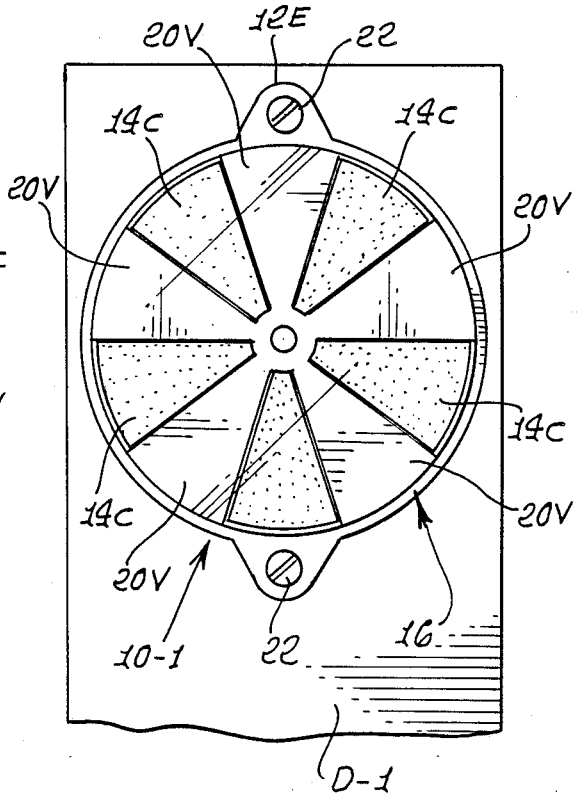
FIG. 3 is a view similar to FIG. 2 but showing a complete traffic signalling device after the signals have been rotated in response to the sensing of a freezing temperature for signalling a frozen condition of the driving surface.

It will be noted from the drawings that the back plate 12 has a pair of diametrically spaced ears 12E having a central aperture 12F adapted for receiving a fastener. These ears 12E along with the fasteners 22 are utilized for securing the traffic signalling devices 10-1, 10-2 and 10-3 on the delineator posts D-1, D-2 and D-3, respectively. The secured traffic signalling device 10-1 is illustrated in FIGS. 2 and 3 in its secured position to the delineator post D-1. When arranged in this fashion, the traffic signalling devices 10-1, 10-2 and 10-3 are visible to an approaching motorist so that the signals displayed by the devices can be readily seen and the utilization of colors for signalling maximizes the ability of the motor vehicle operator to recognize the signals and intelligently respond thereto.

In the practical embodiment of the signalling device 10-1, it will be recognized that the units are sealed after assembly and adjusted through element 12A and cannot be further adjusted. When the sealed units are finally assembled, they are assembled obviously in ambient temperatures that are above the maximum warm temperature such as 35 degrees Fahrenheit to which the device is designed to function. When the device is exposed to a warm temperature and when first mounted along a roadway, if the temperature is above the 35 degree Fahrenheit warm temperature to which the device is set, the signal will display the segments 14W thereon (see FIG. 2) and, therefore, signal the motor vehicle operator that there is essentially no problem in progressing along and viewing the sequential devices 10-1, 10-2, etc. This arrangement, of course, will prevail in all the warmer climates or the warm months of the year in zones subject to freezing, such as in the northern states of the United States, along coastal areas and bodies of water wherein the temperatures may drop below freezing. As noted hereinabove, the device is designed so that the range of temperatures are between 31 degrees Fahrenheit and 35 degrees Fahrenheit. Accordingly, if the freezing temperature drops below 31 degrees Fahrenheit, the signalling device 10-1 will continue to display the cold color 14C or the blue color during this period (see FIG. 3). The blue signal will be maintained until the temperature rises above the 32 degree Fahrenheit temperature but will gradually change from an all blue signal to a combination of the blue and silver colors that are proportioned in accordance with the amount of deviation from the freezing temperature. For example, if the temperature is 33 degrees Fahrenheit, the mixture will be predominantly blue, and as it approaches 35 degrees Fahrenheit, it will be predominantly a silver or warm color (34 degrees Fahrenheit). These extremes in the movements of the light member 14 are controlled by the provision of the stop 14S on the light member periphery in combination with the extent of the slot 16C on the inside skirt 16D of the cover 16.

In operation, then, and assuming the temperature adjacent the delineator posts D-1, D-2 and D-3, as illustrated in FIG. 1, is approximately 35 degrees Fahrenheit, the motorist will view a warm signal as he travels past the delineator posts. It will be assumed that the temperature in the stretch of the roadway $R_L$ as illustrated in FIG. 1 is subject to freezing temperatures so as to produce ice thereon. Accordingly, the distance between the delineator posts D-1 and D-3, or successive posts, will be anywhere from 800 to 1000 feet or more, depending on the terrain, so that the successive traffic signalling devices 10-2 and 10-3 will sense temperatures closer to the freezing temperature than the signalling device 10-1. For example, the signalling device 10-2 may sense a temperature of 33 degrees Fahrenheit to 34 degrees Fahrehheit, and therefore a mixture of the two "warm" and "cold" signals will be displayed. Similarly, if the temperature at the device 10-3 is at 33 degrees Fahrenheit, the signal that is displayed is predominantly a cold or blue signal, so that the motorist in traveling along the roadway $R_A$ will observe the differences in colors at the delineator posts and be alerted to the fact that he is approaching a freezing condition on the forward driving surface such as at surface $R_L$. Three delineator posts have been illustrated in FIG. 1 and described. However, it is recognized that the number of posts is dependent upon the terrain which is to be signalled and a larger number of posts may be utilized with the same spacing or greater spacing, dependent upon the terrain, so as to meaningfully signal the motor vehicle operator as the vehicle travels along the road surface $R_A$ towards the area of lower elevation $R_L$. These parameters will be a matter of experience with the particular highway or roadway. In addition, although delineator posts are not illustrated along the roadway $R_L$ which is covered by ice, delineator posts can also be mounted therealong and beyond the roadway $R_E$ for indicating to the motorist that the temperatures are warming and the extent of the icy surface is coming to an end so that he can guide his motor vehicle accordingly. Similarly, although the delineator posts are not shown for the portion of the road on which a motor vehicle travels from right to left, in FIG. 1 a similar series of delineator posts will be arranged on the opposite side of the roadway from those of the posts D-1, D-2, etc., for signalling the motor vehicle operator traveling from the right to the left.

The various elements of the signalling device 10-1 may be molded from a strong, lightweight plastic that will withstand a large variation of climatic conditions. This permits the device 10-1 to be relatively inexpensively manufactured and assures a relatively long, useful life for the device.

Now referring to FIGS. 10 through 14, an alternate embodiment of the invention will be described. The basic operation of the embodiment illustrated in FIGS. 10 through 14 is the same as the above-described embodiment with the exception that the traffic signalling device 10-5 is arranged and housed in the form of a raised pavement marker to be secured to a road surface for signalling the oncoming traffic. In this arrangement the thermostat element TE is assembled with the signalling means for producing linear motion rather than rotary motion relative to the masking element. The temperature ranges sensed and signalled are basically the same except that in this embodiment, the temperature of the road surface is sensed by the thermostat element TE rather than the ambient air temperature.

First referring to FIG. 10, it will be noted that this diagrammatically illustrates a bridge over a body of water, such as a river or stream that is at a much lower elevation than the road proper. The water is generally designated by the reference letter W with the bridge being identified as BR and the roadway $R_{AB}$ which would be utilized for approaching and driving across the bridge BR from the left to the right, as illustrated in FIG. 10. The traffic signalling devices are mounted along the center line of the roadway in spaced apart relationship and are identified as the devices 10-5, 10-6 and 10-7. Although the devices are illustrated along the center line, they could be mounted adjacent the side of the roadway on the road surface for viewing. When the series of devices 10-5, 10-6 and 10-7 are utilized, a second series of signalling devices can be mounted immediately behind the devices 10-5, 10-6 and 10-7 but turned 180 degrees for viewing by a motorist traveling from the right to the left on the approaching roadway $R_{ABR}$ so that the devices would be viewed only by the motor vehicle operator traveling from the right to the left. Similarly, as discussed hereinabove, the devices 10-5, etc., may be mounted to the driving surface of the bridge BR and the road surface on the opposite side of the bridge, the surface $R_{ABR}$. It will be assumed that on the roadway $R_{AB}$ there will be mounted the traffic signalling device 10-5 in a warm area, i.e., 35 degrees Fahrenheit or above, and as a result of the water stream W, the temperature on the bridge BR is subject to freezing and the bridge driving surface temperature is to be signalled.

In FIG. 11 the assembled embodiment of a device 10-5 is illustrated, all of the remaining signalling devices 10-6, 10-7 being identical. The general configuration of the devices 10-5, 10-6, etc., are of a low profile design with the front and back surfaces sloped at an angle to accommodate motor vehicle tires that may run over it. The cover 29 is thus shaped in the form of a raised pavement marker and may comprise a die cast cover of rigid construction to withstand motor vehicles driving on the device. The cover 29 is constructed with a pair of viewing windows W on the front side thereof for displaying the colored signals. The windows W are of a rectangular configuration and are spaced inwardly from the sloping front of the cover 29 and spaced apart by a solid post 29P, as illustrated. As is usual, the top of the cover is flat and the backside has a sloping solid surface. The light member for this embodiment is best illustrated in FIG. 14 and is identified as a rectangular light member 30 having a plurality of spaced apart areas of different colors for signalling the desired temperature conditions that are sensed. In this instance, the blue or cold signalling areas are identified by the reference numerals 30B which are spaced apart by the warm or silver areas 30C and these alternate areas 30B and 30C are spaced along the entire length of the rectangular light member 30. The back side of the light member 30 is provided with an outwardly extending protrusion 35 adapted for securing the outer flat end of the thermostate element TE. This is identified as the surface 35. In the assembly the light member 30 is mounted immediately behind the masking member 31 which, as in the previous embodiment, is defined for blocking out alternate ones of the colored segments on the light member 30. Accordingly, the masking member 31 is arranged with spaced apart light blocking segments 31B for normally overlying the cold signalling segments 30B on the light member 30 when finally assembled as discussed hereinabove with respect to the vanes 20V. The segments based on opposite sides of the blocking areas 31B are light transmitting areas and are identified as the segments 31C. In the overall assembly the thermostat element TE, which may be of the same construction as is discussed for the previous embodiment, the one free end of the thermostat element TE will be firmly secured to the back side of the light member 30 as best illustrated in FIG. 13.

The cover 29 houses the thermostat element TE within a sub-assembly comprising an upper housing and lens 33. The lens 33L is secured to the front end of the housing 33 as illustrated in FIG. 12. The bottom side of the housing 33 is enclosed by a bottom element 33B for enclosing the thermostat element TE between the upper housing 33 and the bottom element 33B. The bottom element is constructed of a temperature sensitive material that may be bonded to a driving surface. As in the previous embodiment, the thermostat element TE may be adjusted by a fastener or screw 34 that is secured to the top of the upper housing 33 and secures the inner end of the thermostat element TE.

In examining FIG. 12 along with FIG. 13, it will be recognized that the sliding member 30 linearly responds to the mechanical forces generated by the thermostat element TE as a result of sensed changes in temperature by moving the light member 30 linearly. As illustrated in FIG. 13, the movement would be up and down with regard to the plane of the paper and the extremes of movement are identified by the arrowhead M illustrated adjacent the bottom portion of FIG. 13. In this manner, the colored areas 30B and 30C move relative to the masking member 31 to provide the completely cold or completely hot signals or mixtures thereof in accordance with the temperatures sensed by the thermostat element TE.

I claim:

1. A traffic signalling device for detecting the presence of a hazardous driving condition and for signalling either a hazardous or safe driving condition at a preselected distance therefrom, the device comprising a bidirectional, thermal sensitive sensor adapted to provide preselected mechanical forces in response to a preselected temperature range relative to the freezing temperature, and signalling means coupled to said thermal sensitive sensor to be bilaterally movably responsive to the mechanical forces generated by the sensor with increases and decreases of temperatures over said temperature range, said signalling means being adapted for signalling the temperature changes sensed by the thermal sensor over the preselected temperature range to provide a visual signal representative of either a safe or hazardous driving condition in response to the mechanical forces generated by said sensor in response to the sensed temperatures whereby a "warm" sensed temperature provides a first signal and sensed freezing temperature provides a second signal and any sensed temperature between warm and freezing temperature provides a third signal that is a combination of the first and second signals proportioned in accordance to their relationship to the freezing temperature.

2. A traffic signalling device for detecting the presence of a hazardous driving condition and for signalling either a hazardous or safe driving condition at a preselected distance therefrom, as defined in claim 1 wherein said bidirectional, thermal sensitive sensor comprises a thermostat element adapted for providing mechanical operating forces to control the signalling means.

3. A traffic signalling device for detecting the presence of a hazardous driving condition and for signalling either a hazardous or safe driving condition at a preselected distance therefrom, as defined in claim 2 wherein said bidirectional, thermal sensitive sensor comprises a coiled, thermostat element adapted for coupling bidirectional, rotary motion to said signalling means.

4. A traffic signalling device for detecting the presence of a hazardous driving condition and for signalling either a hazardous or safe driving condition at a preselected distance therefrom, as defined in claim 2 wherein said bidirectional, thermal sensitive sensor comprises a coiled thermostat element adapted for coupling bidirectional, linear motion to said signalling means.

5. A traffic signalling device as defined in claim 1 wherein a plurality of said devices are mounted and spaced apart a preselected distance along a driving surface for signalling the driving conditions at each of said devices.

6. A traffic signalling device for detecting the presence of a hazardous driving condition of a road surface as a result of the freezing temperature at the road surface, the device comprising mechanical, thermal sensitive temperature sensing means having a coiled configuration with flat ends to provide preselected mechanical, bidirectional forces in response to the sensing of temperature changes causing changes in the curvature of the coiled configuration of said sensing means thereby producing said forces, plate means having a mounting stud securing one of the flat ends of the coiled, mechanical sensing means, a light member securing the remaining end of the coiled, mechanical sensing means to one side thereof to be movable in accordance with the generated forces provided by said sensing means, the opposite side of the light member having light reflective areas of preselected, different colors so that the areas of the same colors are spaced apart by an area of a different color on said opposite side of the member to provide light reflective areas, one of the colors being representative of an above freezing temperature and the other color being representative of a freezing temperature, mask means mountable with said opposite side of the light member and constructed and defined with light transmitting areas spaced between light blocking areas wherein each of the areas are substantially coextensive with the reflective areas of different colors, so that when the light transmitting areas are in overlying, substantial alignment with the reflective areas of a single color on the light member the areas of a different color are in overlying, substantial alignment with the light blocking areas of the mask means, and cover viewing means secured to said plate means with the mask means mounted with the opposite side of the light member and having the light transmitting areas aligned with the reflective areas of the light member having the color representative of an above freezing temperature so that the areas of the different color are substantially non-visible from the opposite side of the mask means and outside of the cover means, the light member being constructed and arranged within the cover means to permit it to be movable in response to the forces provided by the sensing means relative to the mask means, and normally arranged with the mask means to display only the colored areas representative of an above freezing temperature, the exposure of the thus defined signalling device to temperatures around the freezing temperature causing the mechanical sensing means to provide forces moving the light member relative to the mask means when the device is exposed to temperatures adjacent to and approaching a freezing temperature and to continuously move the light member to cause the device to display both colors as the temperatures change toward freezing until a freezing temperature is sensed whereby the device displays only the color representative of a freezing condition.

7. A traffic signalling device as defined in claim 6 wherein said mounting stud is adjustable for controlling the temperature range of the sensing means.

8. A traffic signalling device as defined in claim 6 wherein the light member is a disk having a central shaft extending from opposide sides of the disk, the plate means mounting stud being constructed and defined relative to one end of the central shaft to accommodate the shaft for permitting relative rotary motion between the disk and the plate means, the mask means being constructed and defined relative to the opposite end of the central shaft for said disk to accommodate said shaft for permitting relative rotary motion between the disk and the plate means when secured with the cover means.

9. A traffic signalling device as defined in claim 6 wherein the light member is a rectangular plate having a central securing element for securing one of the flat ends of the coiled sensing means and secured thereto for providing linear movement of the light member between the light member and the mask means when secured with the cover means.

10. A traffic signalling device as defined in claim 8 or 9 wherein said mounting stud has a semi-circular configuration and adapted to be rotatable for adjusting the temperature range of the sensing means.

11. A traffic signalling device as defined in claim 6 wherein the sensing means is constructed and defined for signalling temperatures over a small range of temperatures above and below the freezing temperature.

12. A method of early warning signalling to a motorist in anticipation of ice formation on a driving surface including the steps of mounting in a spaced relationship a plurality of self-contained temperature sensing and signalling devices along a driving surface for visibly signalling in response to the sensed temperatures an ice condition, a non-ice condition or an intermediate condition between the ice and non-ice conditions and the direction of change between said two conditions at each of said signalling devices, and continuously signalling an advancing motorist of the ice or frosting and non-ice or non-frosting condition of the road surface at each location of said devices and the continuous changes in road condition between the ice and non-ice conditions and vice-versa and the direction of the changes at each location of the devices as viewed by the motorist viewing in sequence each of the plurality of signalling devices while traveling along the driving surface.

13. A method of early warning signalling to a motorist in anticipation of ice formation on a driving surface as defined in claim 12 wherein the signalling is provided by two preselected colors, one of the selected colors being representative of a "hot" temperature above freezing and a different color being selected to represent a "cold" temperature representative of a freezing temperature and the mixture of the two colors being proportioned between the "hot" and "cold" colors in accordance with the direction of change towards a completely "hot" signal or a completely "cold" signal in accordance with the direction of change of the temperatures relative to the freezing temperature and the distance from the portion of the driving surface that is exposed to a freezing or lower temperature whereby the signals change from a "hot" signal to a "cold" signal gradually as the motorist views the signals of the spaced signalling devices to alert the motorist of the changing temperature prior to reaching the driving surface having the ice formation signalled by the "cold" color.

14. A method of early warning signalling to a motorist of the ice or non-ice condition of a driving surface and the direction of change between the two driving conditions, including the steps of providing a plurality of self-contained temperature sensing and signalling devices for continuously signalling a motorist travelling on a driving surface of the driving condition of the surface as he travels therealong of either an ice condition on the surface, a non-ice condition on the surface or the intermediate conditions between the ice and non-ice conditions and the continuous direction of changes towards or away from an ice condition at each of said signalling devices, and mounting a sufficient number of the signalling devices in a preselected spaced apart relationship along a driving surface for viewing of the devices by the motorist as he approaches each of the signalling devices and so that when the motorist sequentially views the signals thereof and any intermediate sequential changes in the signals to permit the motorist to recognize in advance a change towards an ice condition on the surface or away from an ice condition on the surface as he travels on the driving surface to thereby alert the motorist of an ice driving surface in advance of reaching said iced surface.

15. A method of advance warning signalling to a motorist as defined in claim 14 wherein each of the signalling devices displays a signal of a preselected color representative of a sensed ice condition or freezing temperature condition or a signal of another color representative of a sensed non-ice or non-freezing temperature condition or displays a signal having a combination of the preselected color and the another color in accordance with the sensed driving condition and advancing in the direction of one of the colors in accordance with the direction of change of the sensed driving conditions.

16. A method of early warning signalling to a motorist in advance of the presence or absence of an ice or frosting condition on a driving surface at a point forward of the motorist's driving position on a driving surface, including the steps of selecting a driving surface or surfaces having locations thereon where icing conditions are likely to arise or have been known to occur along a preselected distance or distances of the driving surface along with non-icing locations along the same driving surface, mounting a plurality of early warning self-contained temperature sensing and signalling devices along the non-icing driving surface immediately prior to the selected location on the driving surface subject to icing conditions including along the surface subject to an icing condition, each of the early warning signalling devices providing a visible indication to an approaching motorist of the presence or absence of an ice condition adjacent thereto by providing an indication of the absence of an ice condition or the presence of an ice condition or the intermediate conditions indicating the directions of change between the ice condition and non-iced condition and vice versa as the motorist approaches the selected driving surface and drives thereon, spacing the early warning signalling devices a preselected distance apart along the driving surface for the continuous signalling to a motorist of the driving condition of the surface along the driving surface as the motorist views each of the spaced early warning devices sequentially in approaching and driving along the selected location on the driving surface.

17. A method of early warning signalling as defined in claim 16 wherein each of the signalling devices provides a signal of a preselected color representative of an ice condition or a signal of a different color representative of a non-icing condition and signals that are a combination of said colors representative of driving conditions advancing in the direction of an ice condition or in the direction away from an ice condition in accordance with the direction of temperature changes along the driving surface.

18. A method of early warning signalling to a motorist in anticipation of ice formation on a driving surface to be encountered by the motorist including the steps of providing a thermal sensitive element adapted for sensing the ambient temperature of the air or a surface exposed to the ambient temperature and providing visible signals representative of a freezing temperature or a nonfreezing temperature or intermediate temperatures changing between the freezing and non-freezing temperatures and vice versa and the direction of change, mounting a plurality of the thermal sensitive elements in a spaced relationship along a driving surface for sensing and signalling the ambient air temperature at the driving surface and providing a visible signal representative of an icy driving condition, a non-icy driving condition or an intermediate condition changing between the freezing and non-freezing driving conditions and vice versa, and continuously signalling an advancing motorist by means of the spaced arrangement of thermal sensitive elements when the motorist views the visible signals sequentially during the advancement along the driving surface to warn the motorist of the changing condition of the driving surface as the sensed temperatures signal changes toward a freezing condition to alert the motorist of an approaching iced driving surface prior to reaching the iced driving surface to thereby allow the motorist to reduce the motor vehicle speed prior to driving on the iced surface.

19. A method of early warning signalling to a motorist as defined in claim 18 wherein the visible signals comprise at least two preselected colors, one of the colors representative of a "hot" temperature representative of an above freezing temperature and another color representative of a "cold" temperature representative of a freezing temperature or below freezing temperature.

20. A method of early warning signalling to a motorist as defined in claim 19 wherein said "hot" color is a silver or the like color and said "cold" color is a blue or the like color.

21. A traffic signalling device as defined in claim 3 including means for mounting the traffic signalling device above a supporting surface to be viewed by a passing motorist.

22. A traffic signalling device as defined in claim 3 wherein the traffic signalling device is constructed and defined to be mountable on a supporting surface to be viewed by a passing motorist.

23. A traffic signalling device as defined in claim 6 including means for mounting the traffic signalling device above a supporting surface to be viewed by a passing motorist.

24. A traffic signalling device as defined in claim 9 wherein the cover viewing means is constructed and defined in the form of a pavement marker to be directly mountable on a supporting surface.

* * * * *